US007831059B1

(12) United States Patent
Sahyoun

(10) Patent No.: US 7,831,059 B1
(45) Date of Patent: Nov. 9, 2010

(54) SELF-COOLED ELECTRO-MAGNETIC AUDIO TRANSDUCER

(76) Inventor: Joseph Y. Sahyoun, 3031 Hopkins Ave., Redwood City, CA (US) 94062

( * ) Notice: Subject to any disclaimer, the term of this patent is extended or adjusted under 35 U.S.C. 154(b) by 1041 days.

(21) Appl. No.: 11/592,388

(22) Filed: Nov. 3, 2006

(51) Int. Cl.
*H04R 25/00* (2006.01)

(52) U.S. Cl. ..... 381/397; 381/396

(58) Field of Classification Search ..... 381/396, 381/397, 400, 407, 412, 433; 310/12, 15, 310/17, 190; 29/594
See application file for complete search history.

(56) References Cited

U.S. PATENT DOCUMENTS 5,042,072 A 8/1991 Button ..... 381/192
5,357,586 A 10/1994 Nordschow et al. ..... 381/199
5,497,428 A 3/1996 Rojas ..... 381/199
5,909,015 A 6/1999 Yamamoto et al. ..... 181/156
6,243,479 B1 6/2001 Proni ..... 381/420
6,327,371 B1 12/2001 Proni ..... 381/397
6,330,340 B1 12/2001 Proni ..... 381/397

*Primary Examiner*—Suhan Ni
(74) *Attorney, Agent, or Firm*—Allston L. Jones; Peters Verny, LLP

(57) ABSTRACT

An electro-magnetic audio transducer that is self-cooling by inhaling and exhausting an area that is separated from the reminder of the transducer by an instantaneous decrease or increase, respectively, of the pressure within that area by the movement of a coil when electrically excited. The coil being wound on a bobbin that defines an interior cavity that changes in size as the coil is excited causing that size to increase or decrease thus inhaling or exhausting, respectfully, air into or out of the cavity by the pressure change. That movement of air resulting in convective cooling of the coil and transducer. The bobbin encircling a magnetic pole piece with a cooling cap on top thereof with slots therethrough through which air is drawn in opposite directions as the size of the cavity within the bobbin changes size as the coil is electrically excited.

18 Claims, 9 Drawing Sheets

SELF-COOLED ELECTRO-MAGNETIC AUDIO TRANSDUCER

BACKGROUND OF THE INVENTION

1. Field of the Invention

The present invention relates generally to electro-magnetic transducers and, more particularly, to electro-magnetic transducers that are self-cooled by means of instantaneous pressure changes created by the natural motion of the transducer coil and the bobbin on which it is wound.

2. Description of the Prior Art

There are many electro-magnetic transducers on the market that were designed for the purpose of self-cooling. However, some of those designs are very expensive and their cost makes them unmarketable, there are others that produce marginal cooling, and still others that offer virtually no cooling. Most common designs include a vertical venting passage through the center of the pole piece of the electro-magnetic motor of loudspeakers. The vertical passage, during an outward stroke of the voice coil of the electro-magnetic motor causes cold air to be sucked from beneath the electro-magnetic motor into the vertical passage and up underneath the loudspeaker dust cap; and during the inward stroke of the voice coil the hot air beneath the dust cap is expelled from the region of the electro-magnetic motor and then the system is ready for another cycle on the next outward stoke of the voice coil. Unfortunately, these types of a cooling systems only provide cooling of the inside surface of the vertical passage of the pole piece with the temperature of the voice coil only reduced by the inefficient convection of heat transferred from the voice coil to the pole piece and by conduction from the outside of the pole piece to the inside of the voice coil. Thermal cooling in this way is limited by to free air convection, i.e., heat convection through the air between the voice coil and the pole piece.

The speaker design in U.S. Pat. No. 5,357,586 by Nordschow teaches mounting the speaker motor below the bottom of the basket to a ring that has spaced apart venturi passages that open into the cavity above the top plate of the motor and below the spider. Additionally, venturi passages are formed through the lower center of the pole piece in communication with the gap through which the voice coil travels with the venturi passages on one side of the pole piece opening into the voice coil gap and on the other side of the pole piece opening to the center of the pole piece. Additionally, an aerodynamically shaped body is inserted into the top of the pole piece with the smaller end extending into the center of the pole piece while defining a narrow ring passage around the top edge of the pole piece and the larger end on the aerodynamically shaped body thus creating a venturi passage opening into the lower center of the pole piece from the cavity below the dust cap. This design is thus limited to the use of a special speaker basket, only mounting the speaker motor to the outside bottom of the basket, and the machining of the opposing venturi passages through the interior bottom portion of the pole piece. Thus this design requires expensive machining of the pole piece and greatly limits variations on the design of the completed speakers that can utilize this cooling technique making it very impractical for all of those reasons.

The speaker design in U.S. Pat. No. 5,909,015 by Yamamoto el al. teaches the importance of loud speaker cooling, specifically self-cooling. Yamamoto's approach to self cooling is to push and pull air through narrow pathways that are carved out of the top plate and the bottom plates of the electro-magnetic motor with those pathways being perpendicular to the axis of movement of the voice coil. These plates are typically steel and therefore expensive to machine. This attempted solution creates turbulent air flow and wind noise 90° off the axis of movement of the voice coil. Additionally, the holes in the top/bottom plates provide a major pathway for metal debris to cross into the magnetic gap. This is an eminent situation that will destroy the speaker once the debris reaches the voice coil. During speaker installation is very likely that the installer will place the speaker in an environment that contains metal debris as it is often necessary to grind metal pieces to enlarge a hole in the location in which the speaker is to be installed (e.g., in car installations). The metal debris will be attracted to the outside ring of the bottom and the top magnet plates. During airflow these debris will migrate into the magnetic gap through these large openings.

In U.S. Pat. Nos. 6,330,340 and 6,327,371, both by Proni, the speaker design includes a vented collar placed between the voice coil and the cone (diaphragm). Those vents through the collar allow air to be sucked into a cavity below the dust cap and blown out through the vents as the volume of that cavity changes during operation of the speaker, the vents in the collar allow the air to travel in and out of the cavity below the dust cap to improve the cooling system. This design is too complex and does not deal with forced air cooling. Air is allowed into the cavity below the dust cap without being forced directly to the hottest component of the electro-motive motor, i.e. the voice coil.

In U.S. Pat. No. 6,243,479, also by Proni, which is similar to the cooling technique of U.S. Pat. No. 5,357,586 discussed above, shows a pole piece cooling system that includes a cavity located in the pole piece through which the voice coil passes. This design has a major problem that makes the speaker unattractive due to the highly audible noise that the highly turbulent air flow that it creates. Additionally, this solution is expensive to manufacture.

In U.S. Pat. No. 5,497,428 by Rojas the cooling system includes a vented pole piece that directs air flow between the center of the pole piece and the gap through which the voice coil travels. To implement this design, the pole piece is a complex structure formed with the top of the center passage closed by a conical structure to direct the air flow to and from a plurality of passages machined through the side of the pole piece in communication with the gap through which the voice coil passes. Further those holes through the side of the pole piece causes a major reduction in the flux density in the gap. This cooling solution is too expensive and complex in its execution, moreover, the Rojas solution, as well as the Proni solutions, each delivers cooling air to the voice coil from openings that are below the top plate of the electro-magnet of the electro-magnetic motor of the loudspeaker. Under the top plate, the side pathways are very narrow and thermal conductivity is at its maximum only when the voice coil is in its most outward position.

Thus a speaker cooling design is needed that does not require expensive machined parts or a special basket. One that can be used with a variety of speaker designs with few limitations. The present invention provides such a design.

SUMMARY OF THE INVENTION

The present invention is an electro-magnetic audio transducer that is self-cooling by inhaling and exhausting an area that is separated from the reminder of the transducer by an instantaneous decrease or increase, respectively, of the pressure within that area by the movement of a coil when electrically excited. The coil being wound on a bobbin that defines an interior cavity that changes in size as the coil is excited causing that size to increase or decrease thus inhaling or exhausting, respectfully, air into or out of the cavity by the pressure change. That movement of air resulting in convective cooling of the coil and transducer. The bobbin encircling a magnetic pole piece with a cooling cap on top thereof with slots therethrough through which air is drawn in opposite directions as the size of the cavity within the bobbin changes size as the coil is electrically excited.

The illustrative embodiment of the present invention discussed herein is that of an audio speaker voice coil forced air convective cooling provided by a cooling cap over the center of the pole piece with elongated slots therearound the bottom edge that are not perpendicular to the bottom edge. On the up stroke of the voice coil, air is drawn through the slots into the cavity within the voice coil bobbin with the slots longer than they are wide and angled away from perpendicular to the cooling cap edge creating an air vortex in the cavity directed toward the bobbin surface convectively cooling of the voice coil. Voice coil drawn downward exhausts the cavity between the magnet and the pole piece and out holes in motor bottom further cooling the voice coil, forced back through the cooling cap slots and out the pole piece center, and through cooling holes in the bobbin into the speaker frame and out between the struts in the frame.

DETAILED DESCRIPTION OF THE EMBODIMENTS OF THE PRESENT INVENTION

The following discussion is of an example embodiment of the self-cooling electro-magnetic audio transducer of the present invention as illustrated in the accompanying figures.

The example embodiment of the present invention discussed below pertains to a self-cooling audio speaker. Typically speakers have a motor structure that includes a magnet, back plate, pole piece, and a top plate. While the motor is stationary, a voice coil is always moving as a result of the changing electro-magnetic field created by the voice coil in interaction with the constant magnitude magnetic field of the magnet. As the voice coil moves it causes the cone, or diaphragm, attached to the voice coil to also move to create an acoustic wave from the surface thereof. This motion has also been used to provide cooling of the voice coil to minimize the probability of burn-out thereof. While many cooling designs have been disclosed in the past, they require costly modifications to various components in the speaker. The present invention provides a cooling solution that does not require modifications to other parts of the speaker and can be used with substantially all speaker designs.

Figure 1:
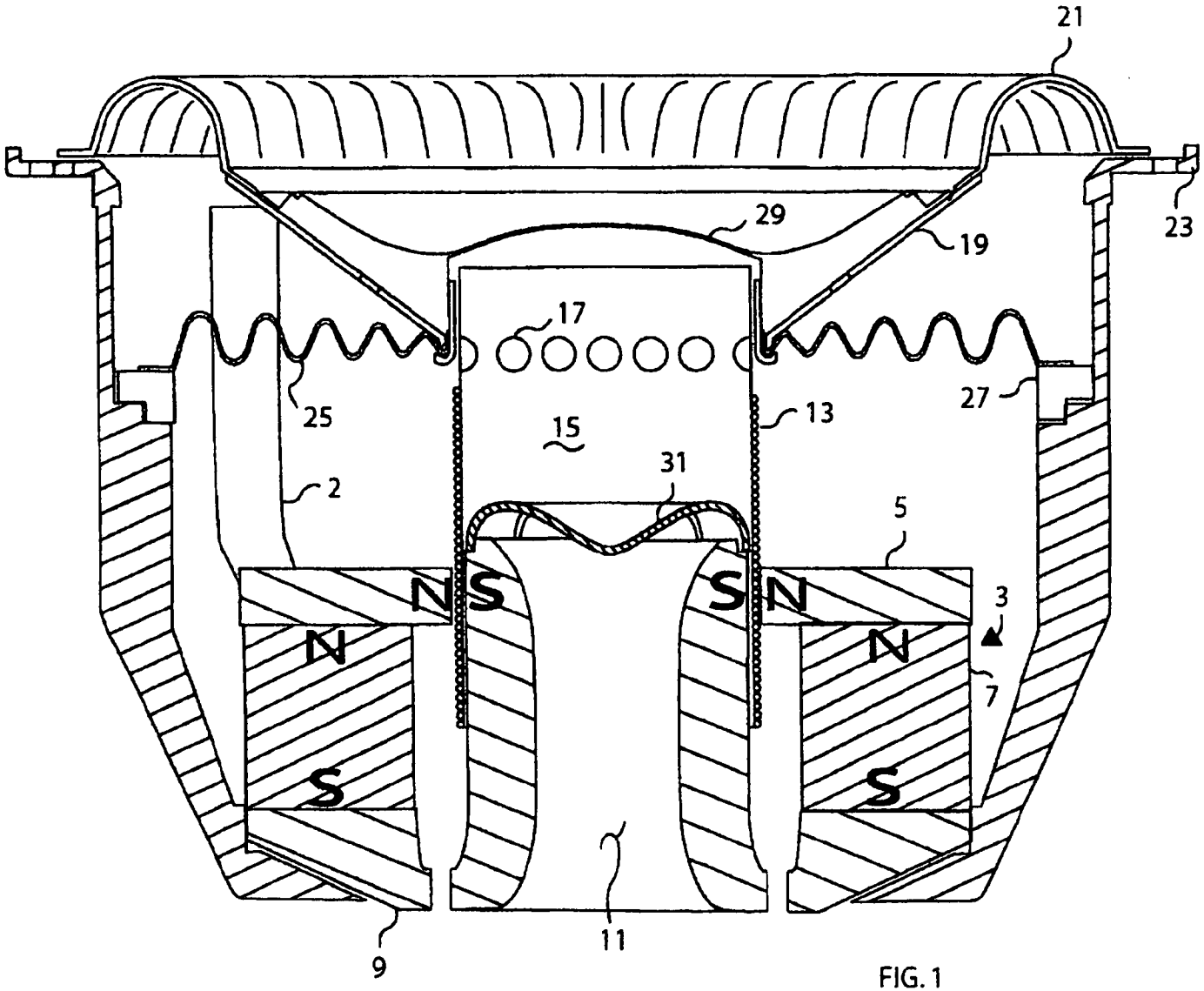
FIG. 1 is a cross-section of a typical speaker that incorporates the present invention.

FIG. 1 shows, in cross-section, a typical speaker having a frame or basket 1 that has evenly spaced openings 2 between each of the top to bottom struts around the circumference of the frame 1. To minimize confusion when viewing FIG. 1, only one opening 2 is shown. The speaker includes a typical electro-magnetic motor 3 mounted in the bottom of basket 1. Motor 3 includes a ferro-magnetic top plate 5, circular magnet 7 with a circular center hole and a bottom plate 9 that includes a generally annular pole piece 11 that passes upward through the center holes in magnet 7 and top plate 5 with a gap between them and the outer surface of pole piece 11 and voice coil 13 wound on a generally cylindrical bobbin 15 that extends into the gap in motor 3 around pole piece 11. Extending into the top of basket 1 is a cone, or diaphragm, 19 with the top edge connected to rim 23 of frame 1 with a surround 21, while the inner edge of diaphragm 19 is connected near the top edge of bobbin 15. At the same connection point with bobbin 15, the inner edge of spider 25 is also connected and the outer edge of spider 25 is connected to a basket interior projection 27 that is parallel to rim 23 of frame 1. The connection point of diaphragm 19 and spider 25 with bobbin 15 is above both the top of voice coil 13 and cooling holes 17 that is above, and spaced apart from, voice coil 13. Additionally, a dust cap 29 is shown covering the top of bobbin 15.

Also shown in FIG. 1 is a cooling cap 31 of the present invention with cooling cap 31 affixed to the top of pole piece 11 covering the center hole therethrough. In this example embodiment, the bottom edge of cooling cap 31 is substantially circular. Cooling cap 31 can be made of any desired material and be attached to the top of pole piece 11 by any appropriate means. If cooling cap 31 is made of a ferro-magnetic material, then magnetic attraction will retain the cooling cap on the top of pole piece 11.

Figure 2:
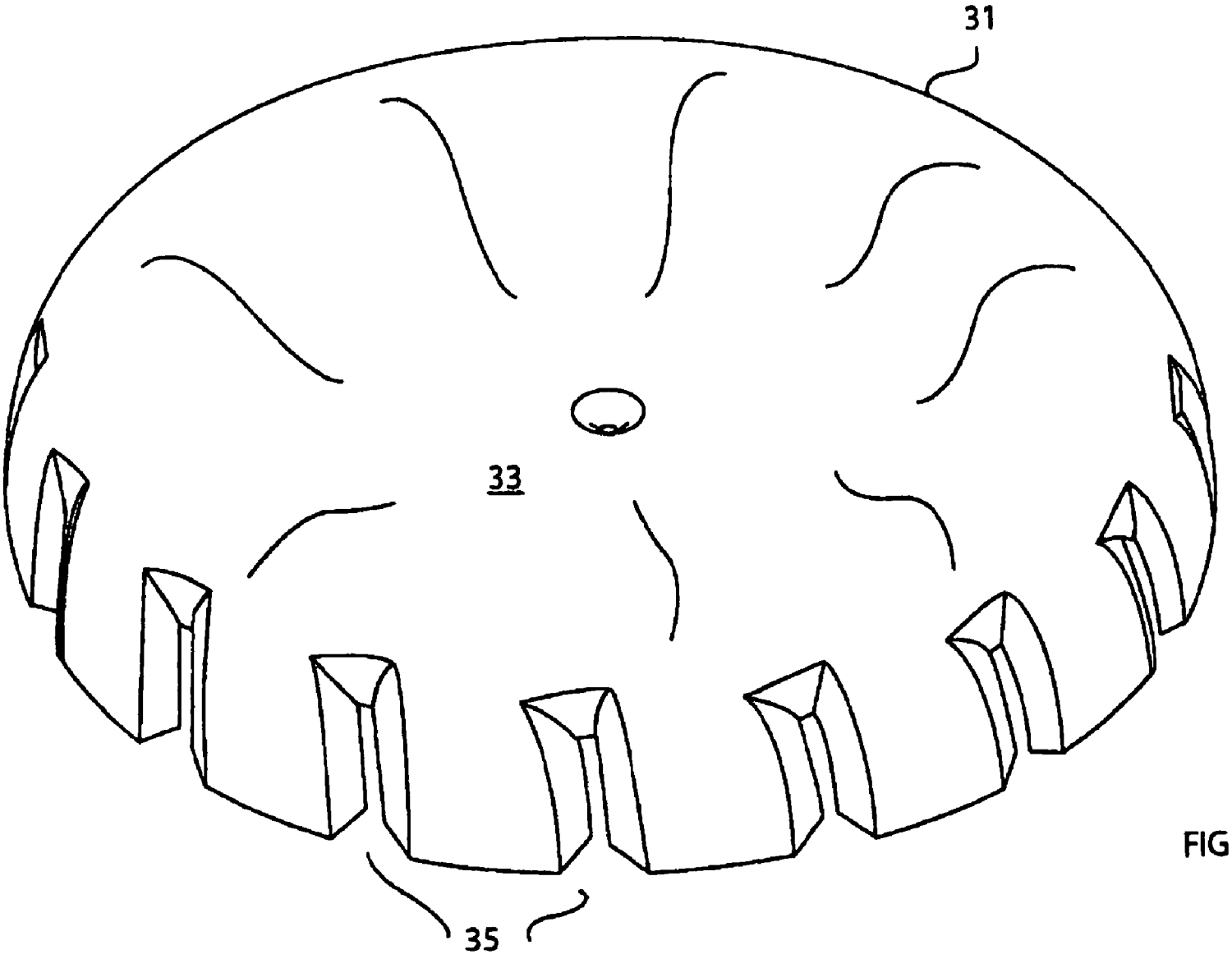
FIG. 2 is a perspective top view of the cooling cap of the present invention that is incorporated in the speaker shown in FIG. 1.
Figure 3:
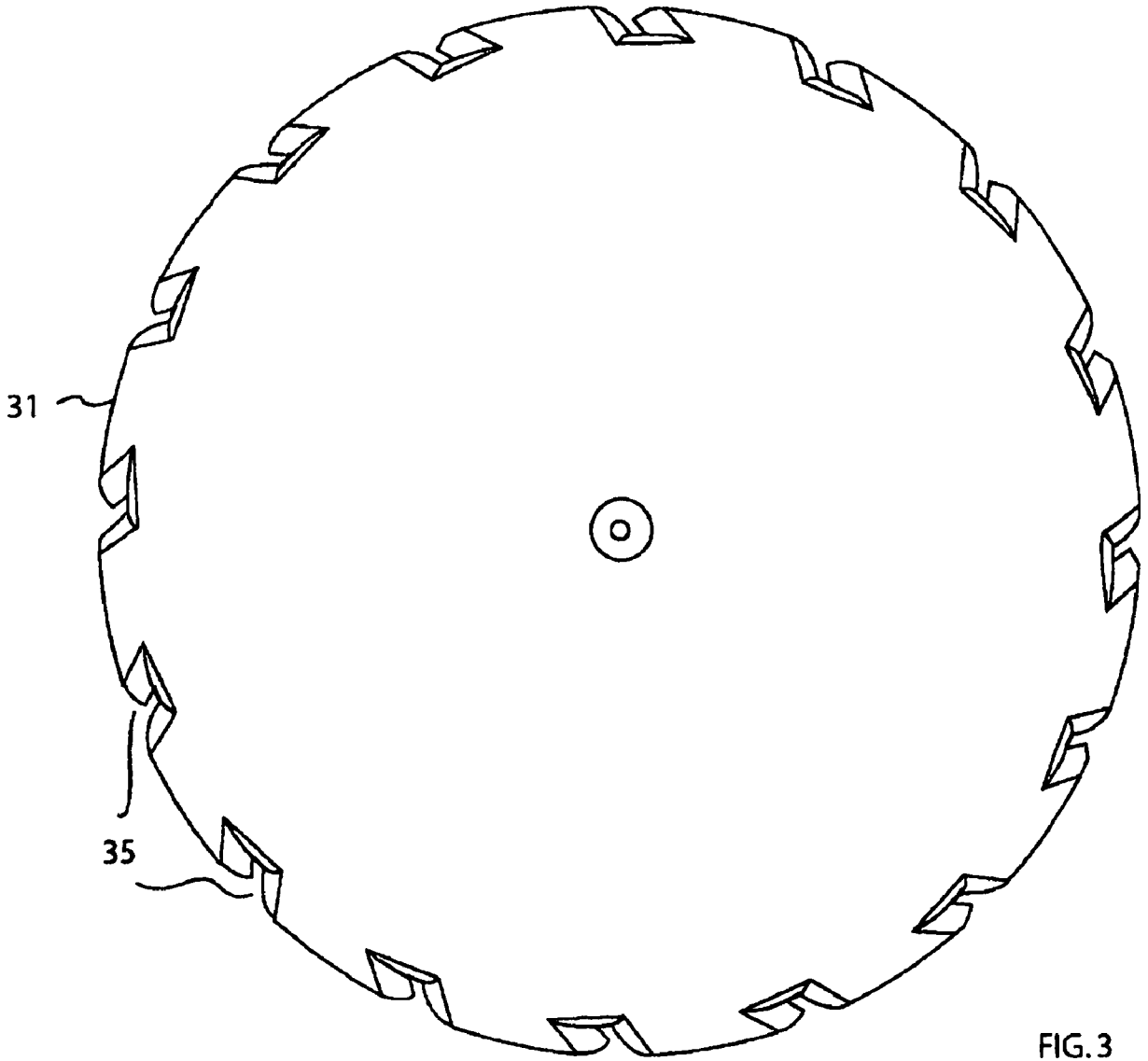
FIG. 3 is a top view of the cooling cap of FIG. 2.
Figure 4:
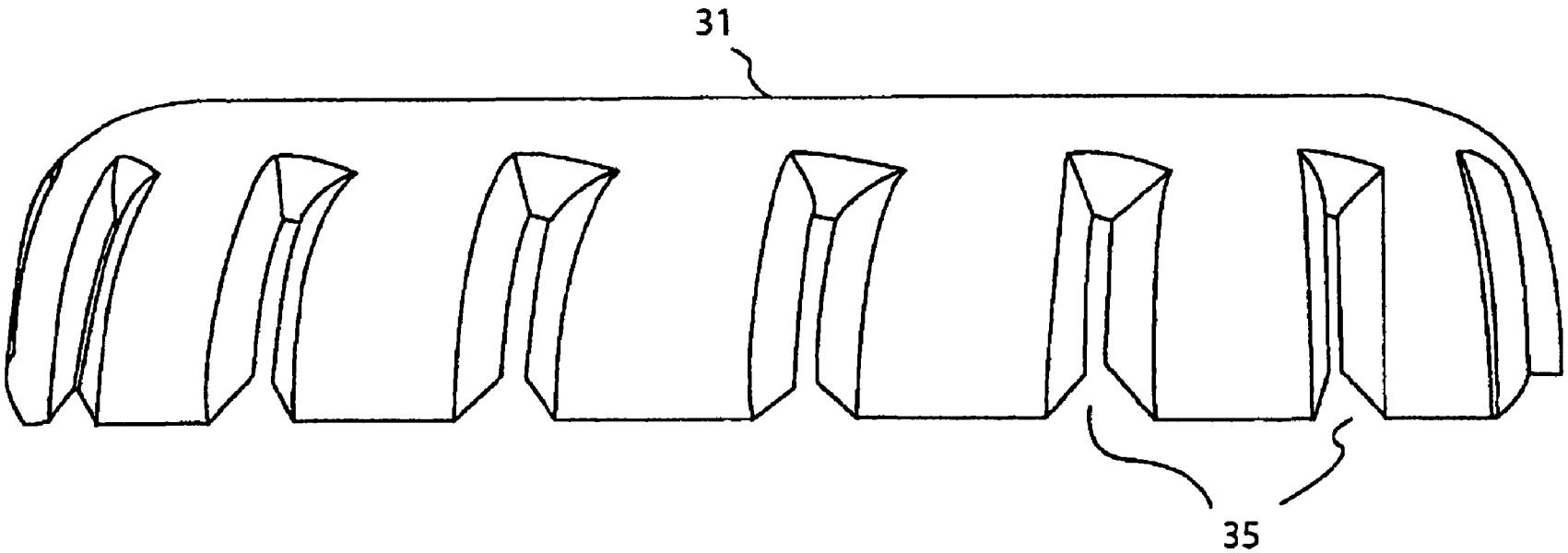
FIG. 4 is a side view of the cooling cap of FIG. 2.

FIGS. 2, 3 and 4 show a perspective, top and side view, respectively, of the cooling cap 31 shown in FIG. 1. The diameter of cooling cap 31 is slightly small than the outer diameter of the top of pole piece 11 to insure that the movement of voice coil bobbin 15 is not interfered with during speaker operation (see FIG. 1). In FIGS. 1 and 2 it can be seen that cooling cap 31 has an optional downward extending dimple 33 with the outer edge of cooling cap 31 curving downward. In the views of FIGS. 2 and 4 the outer edge is shown as being substantially perpendicular to the center of cooling cap 31. Further, the downward curving edge of cooling cap 31 defines a plurality of spaced apart elongated slots 35 shown here as angled slightly to the left in relation to, and open at, the bottom edge of cooling cap 31. While the openings through the edge of cooling cap 31 that are shown in FIGS. 2, 3 and 4, are elongated narrow slots they can have any elongated shape, regular or irregular, e.g., an ellipse, narrow diamond, etc. Any shape that is substantially longer than it is wide. The number of openings around the outer edge of cooling cap 31, as well as the width and number of degrees the longest dimension is off vertical, depends on several factors that include the size of the speaker, length of travel of the voice coil and the maximum power that can be applied to the voice coil, as well as other factors.

Figure 5:
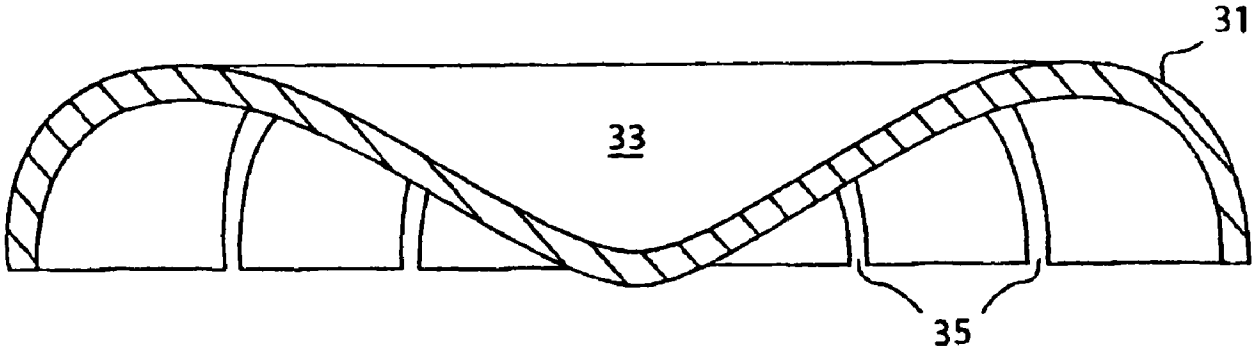
FIG. 5 is a cross-sectioned view of the cooling cap of FIGS. 2, 3 and 4 that has elongated slots.
Figure 6:
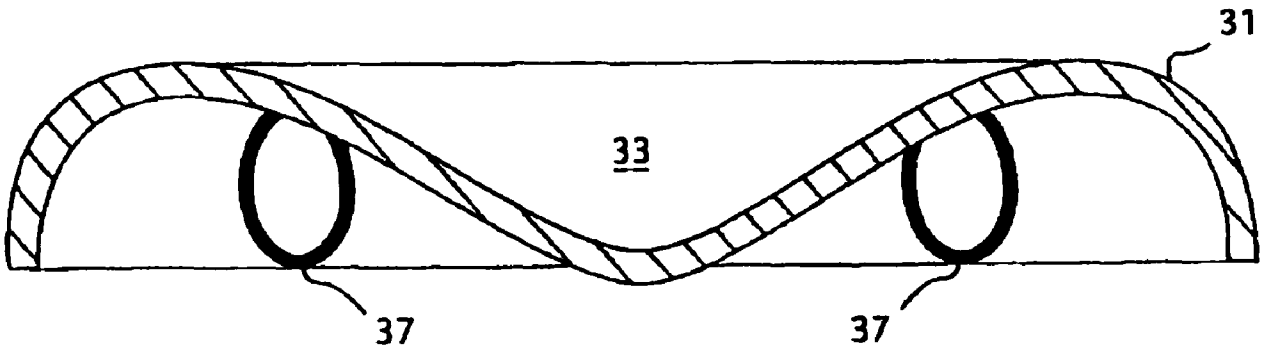
FIG. 6 is a cross-sectioned view of the cooling cap of FIGS. 2, 3 and 4 that has elongated elliptical vent holes in cooling cap 31.

FIG. 5 is a center, vertical cross-sectional view of the cooling cap 31 of FIGS. 2, 3 and 4 that has elongated slots 35 that are angled off vertical relative to the bottom of edge of cap 31 to obtain the air flow pattern desired to provide cooling of the speaker as is described below. Similarly, FIG. 6 is a center, vertical cross-sectional view of the cooling cap 31 with elongated elliptical holes 37 with the major axis of each ellipse angled off vertical relative to the bottom edge thereof. While cooling caps 31 in FIGS. 2, 5 and 6 having a downward extending centered dimple 33, those caps could alternatively have a flat top. It will be seen in the discussion that follows, dimple 33 does provide some improvement in the air flow below cooling cap 31.

Figure 7:
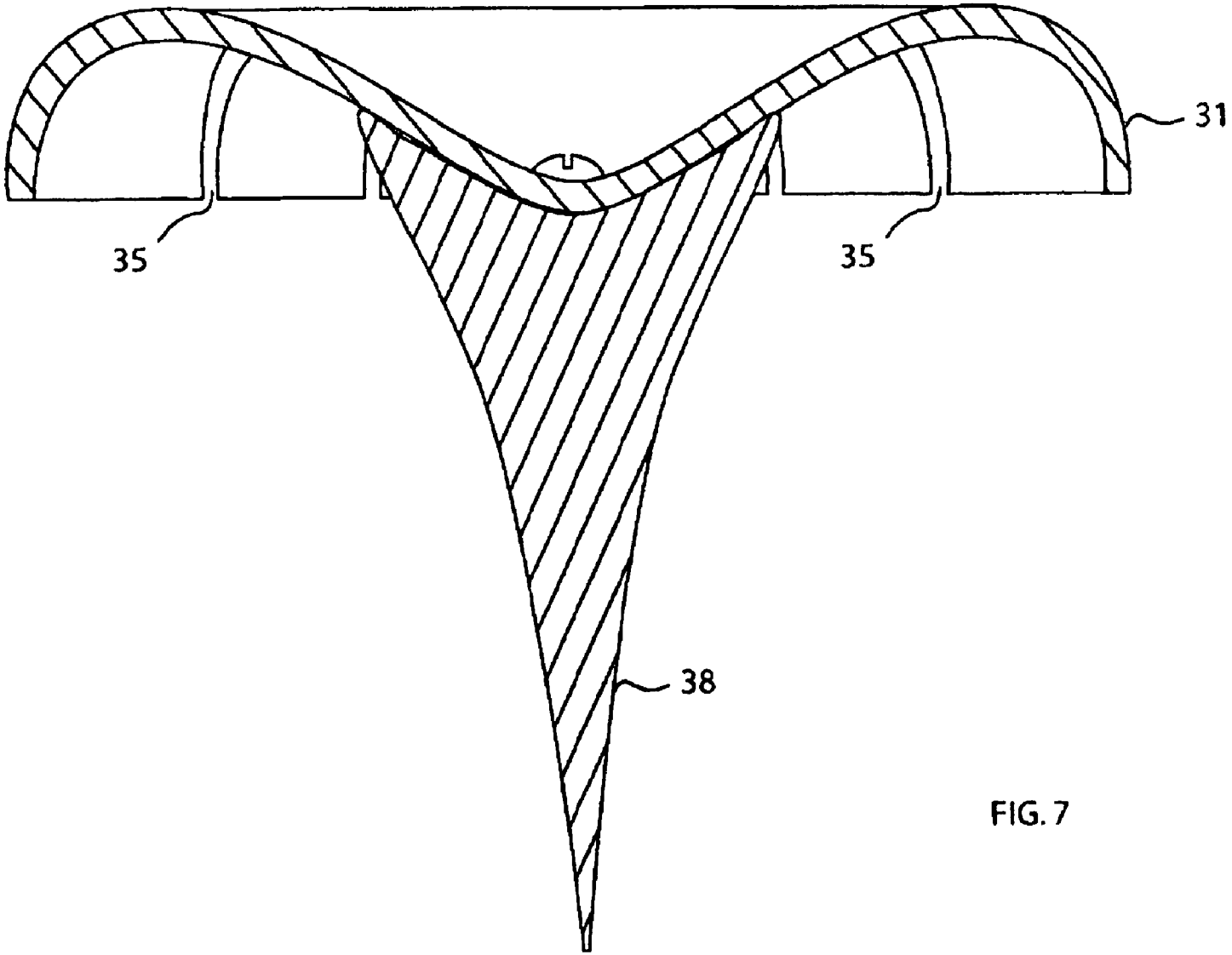
FIG. 7 is a cross-sectioned view of the cooling cap of FIG. 5 that has elongated slots and a spear-like projecting downward from the center of the cooling cap.
Figure 8:
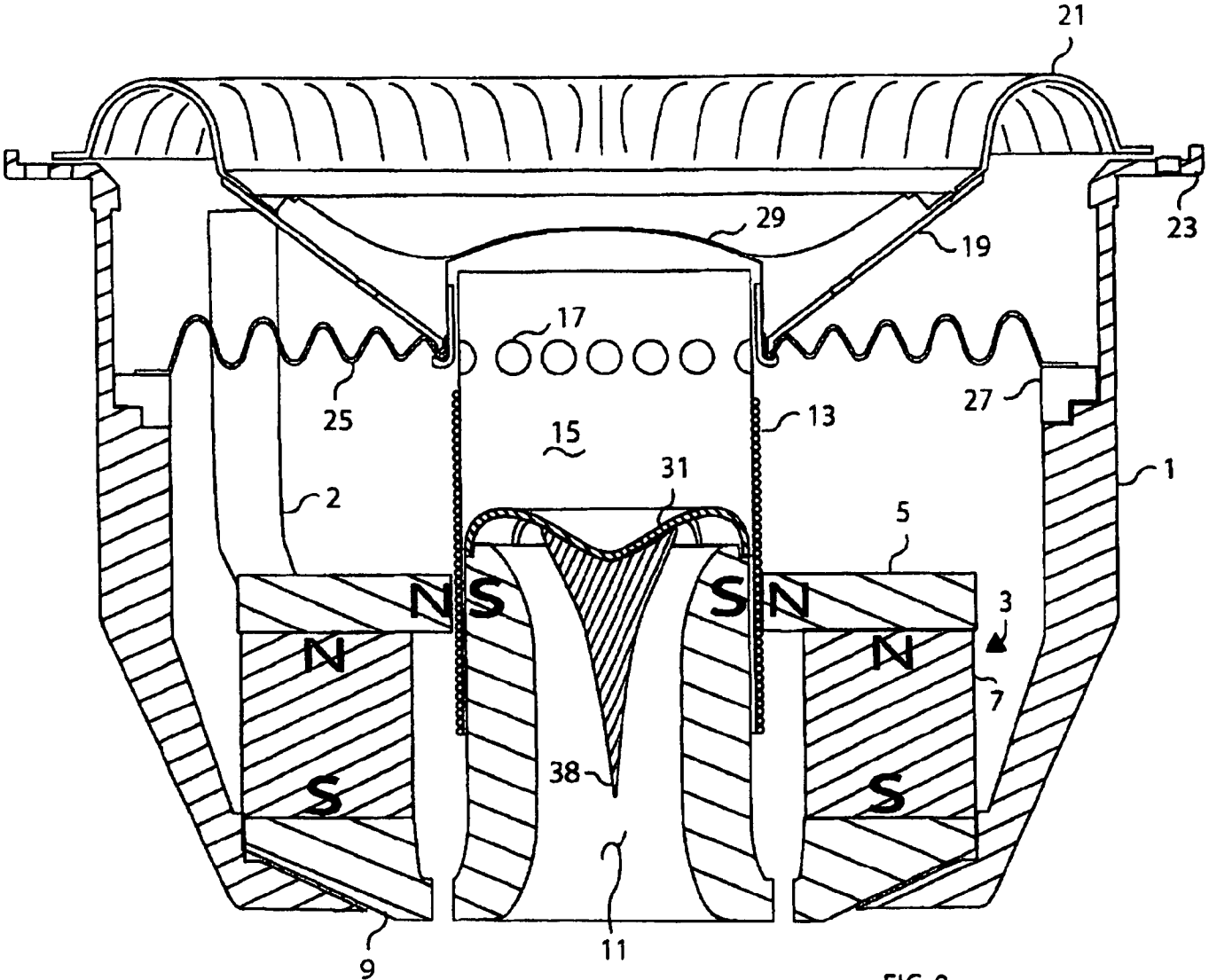
FIG. 8 is the cross-sectioned speaker of FIG. 1 with the cooling cap of FIG. 7.

FIG. 7 shows the cooling cap 31 of FIG. 5 with a spear-like projection 38 that extends downward from the center thereof. In this view spear-like projection 38 resembles a golf tee that has been sliced in half vertically. As shown in FIG. 7, spear-like projection 38 has a progressively smaller horizontal cross-section the further it extends from the underside of cooling cap 31 ending in a point. If the spear-like projection 38 were sliced horizontally anywhere along its length, instead of vertically, the cross-section would substantially be circular, for best performance and even cooling of the speaker, however, cooling would be achieved if it had a different horizontal cross-sectional shape. Additionally, spear-like projection 38 here is shown with a concave outer surface that extends from the proximate end thereof to the point at the distal end. Even so, the outer surface of spear-like projection 38 could be a straight line, or convex. Further, spear-like projection 38 could have a blunt end. However, for the desired air-flow pattern of the present invention the shape of spear-like projection 38 shown in FIG. 7 in experiments has been shown to provide the best performance. The overall length of spear-like projection 38 also has an effect on the total cooling performance of the present invention and is selected to complement that performance while taking into consideration the inner diameter, and length of pole piece 11, and to permit mounting of the speaker in the greatest number of locations, it is best that the overall length of spear-like projection 38 be less than the height of pole piece 11 so the distal end does not extend beyond the bottom of the speaker. FIG. 8 is the cross-sectioned speaker of FIG. 1 with the cooling cap and spear-like projection of FIG. 7.

This design provides the best performance with the concave shape of the side of spear-like projection 38 and the under side of the dimpled center of cooling cap 31 complementing each other to direct the intake air to the side as the voice coil extends upward. Some of the air that exhausts from the cavity above cooling cap 31, when the voice coil is drawn downward, exits slots 35 into an increasing size area (higher pressure to lower pressure) following the curvature of the bottom of cooling cap 31 and the side of spear-like projection 38 with a more laminar flow as it exits the center of the pole piece.

Figure 9:
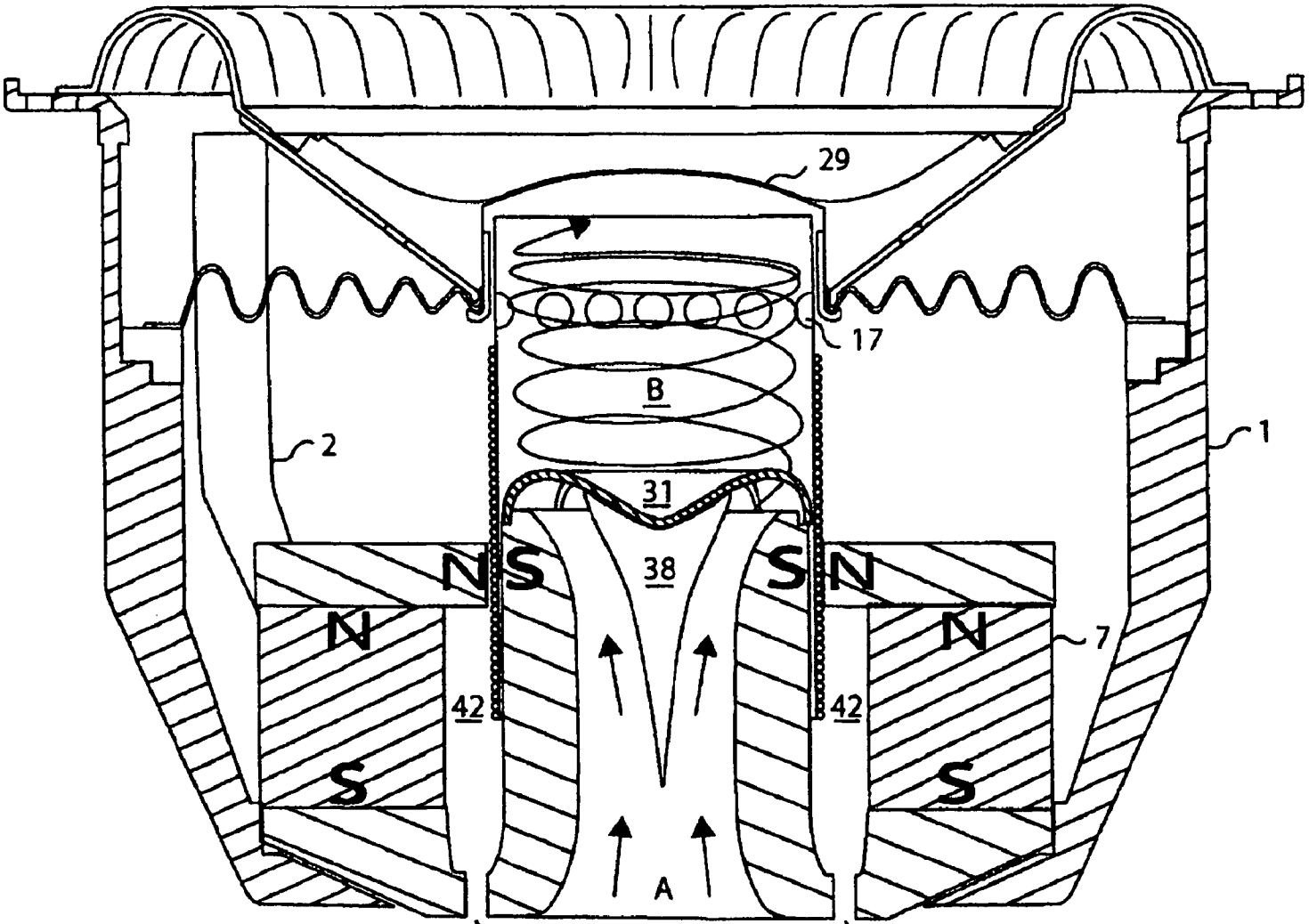
FIG. 9 is the cross-sectioned speaker of FIG. 8 showing the air circulation as the voice coil is driven upward.
Figure 10:
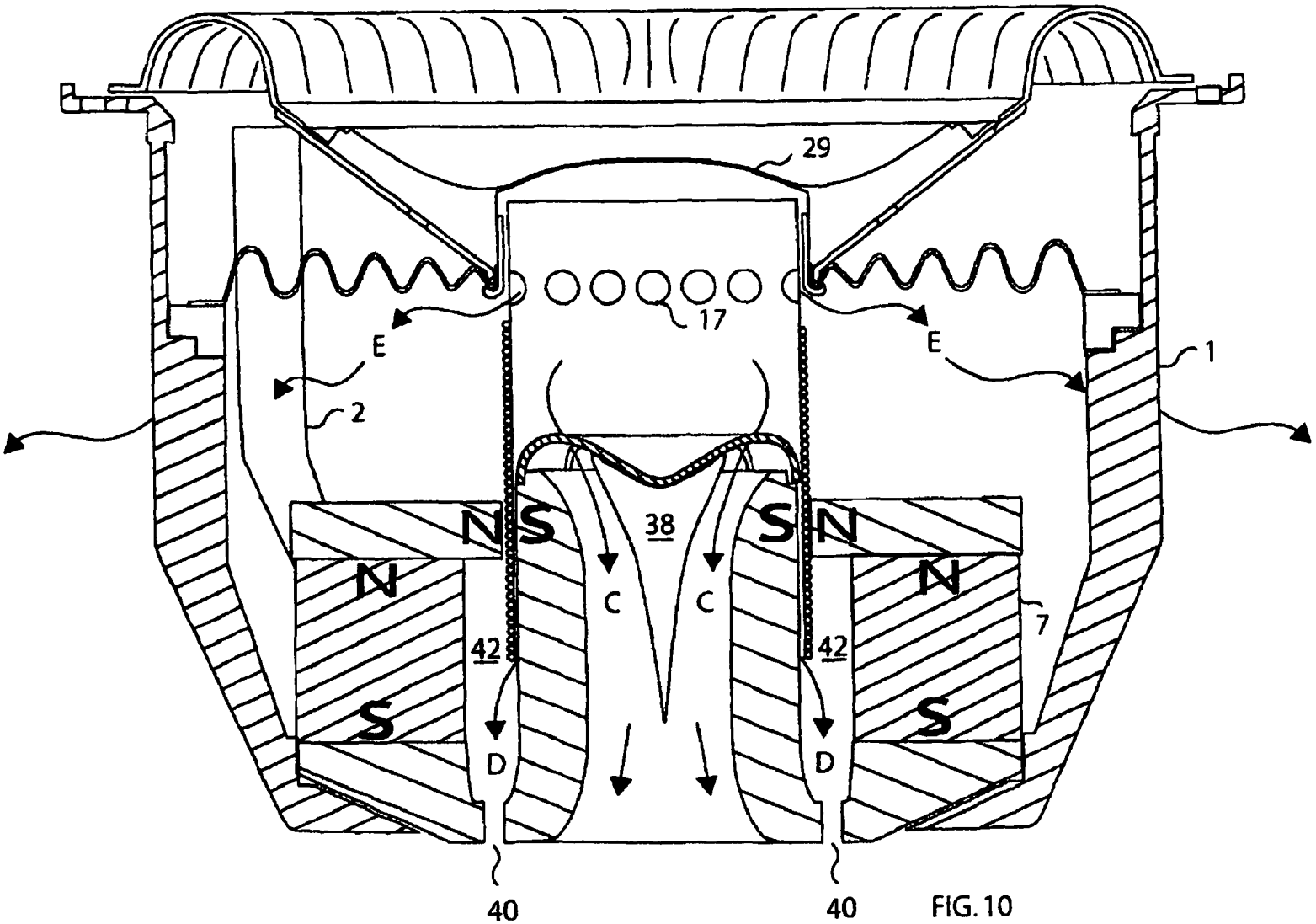
FIG. 10 is the cross-sectioned speaker of FIG. 8 showing the air circulation as the voice coil is pulled downward.

The cooling effect of the present invention is illustrated in FIGS. 9 and 10. In FIG. 9 the air circulation is shown as the voice coil is driven upward, and in FIG. 10 the air circulation is shown as the voice coil is pulled downward. As described below it will be seen that cooling is achieved by forced convection.

In FIG. 9 as the voice coil and bobbin are driven upward, the cavity, or area, bound by cooling cap 31, bobbin 13 and dust cap 29 experiences an instantaneous drop in air pressure that is lower than air pressure beneath cooling cap 31 in the center of pole piece 11 and elsewhere in the speaker. Thus the lower pressure above cooling cap 31 causes air to be drawn through slots 35 in cooling cap 31 into the area within bobbin 13. This is illustrated in FIG. 9 with air "A" being drawn, or inhaled, into the open center of the pole piece 11 and diverted evenly toward the inner side of the pole piece by spear-like projection 38 continuing upward to cooling cap 31, with the underside of the dimple complementing projection 38, to the slots in cooling cap 31. From beneath cooling cap 31 the air is drawn through the slots and into the cavity within the bobbin and beneath the dust cap. With the slots in cooling cap 31 each being angled off-perpendicular by the same angle and direction, and being curved inward toward the center of cooling cap 31 as they extend upward from the bottom edge thereof, a vortex "B" of a whirling mass of air is created above cooling cap 31 in the lower pressure cavity within the bobbin. As the air is drawn through cooling cap 31, the air vortex directs the air mass to the inner surface of the bobbin to maximize convective cooling of the bobbin and the voice coil wound thereon. The direction of rotation of the vortex of air within the cavity, clockwise or counter-clockwise, is determined by the direction of the off-perpendicular angle of the slots in the cooling cap, either right or left. The direction of rotation of the vortex has not been seen to make any difference in the cooling that was achieved. To create vortex "B", the angle of the slots off vertical could be selected to be greater that 0° and less than 90° with that angle selected to determine how close to the top of the cooling cap the initial flow of air strikes the inner surface of the bobbin. In smaller speakers, a smaller angle will likely provide sufficient cooling while in larger speakers a larger angle might provide better cooling. Given various speaker sizes and configurations different angles are likely to be necessary. In the majority of speaker types and sizes a range of angles will likely be between 10° to 60°. In tests preformed on a moderate sized speaker the inclusion of a cooling cap as described above provided about a 15% reduction in the temperature of the voice coil of the same speaker when operated without the cooling cap.

Whether or not cooling holes 17 are included through the bobbin also has an effect on the cooling provided by the present invention. By varying the number, size and location (between the top of the bobbin and the top of the voice coil) the cooling of the speaker can also be varied. Depending on the strength of vortex "B", and the presence, or non-presence, of cooling holes 17, on the up stroke of bobbin 13, some of the air of the vortex may exit cooling holes 17, additional air might be drawn into the bobbin through holes 17 or there might not be an appreciable exchange of air through holes 17.

Referring next to FIG. 10, as the bobbin and voice coil are pulled back down, the air that accumulated in the bobbin cavity on the up stroke experiences an instantaneous increase in pressure that is higher than the air elsewhere in the speaker. Thus air is exhausted from, or forced out of, the bobbin cavity through different paths. This is illustrated in FIG. 10 as air "C" that is forced through the slots in cooling cap 31, air "D" that is forced through the gap between the inside of the bobbin and the outer surface of the pole piece into gap 42 between the voice coil bobbin and the magnet and then out through holes 40 (typically 4-6 holes) through the bottom of the lower plate, while a much greater volume of the air "E" is forced out through cooling holes 17 (if present) in the bobbin into the interior of basket 1 and out through slots 2 in the side of the basket. The presence, size, number and location of holes 17 in the bobbin also has some control over how much of air "D" flows through gap 42 and out holes 40.

While the above discussion of the air flow into and out of the cavity in the bobbin includes the use of spear-like projection 38, that performance is somewhat less efficient if spear-like projection 38 is not used or has a modified shape, and whether or not cooling cap 31 has a top side dimple 33. Without spear-like projection 38 the use of cooling cap alone still provides a major improvement in cooling the speaker than the best of the prior art.

Further, it is anticipated that cooling cap 31 and spear-like projection 38 will be manufactured as two separate pieces. It is anticipated that cooling cap 31 will be made of aluminum or steel and the spear-like projection from a heat resistance plastic or other material. With the two piece construction of those parts, spear-like projection 38 will have a top end surface that complements the shape of the bottom of the center of cooling cap 31 where spear-like projection 38 is fastened, e.g., glued or screwed in place with a screw passed through a center hole in cooling cap 31.

While several example implementations have been given above and in the figures, there are many equivalents in which the present invention could be implemented. Thus the scope of the present invention should only be limited by the full scope of the appended claims.

What is claimed is:

1. An electro-magnetic transducer comprising:

a diaphragm;

a generally cylindrical bobbin defining an interior air chamber having a first end coupled to said diaphragm;

an electrical winding on said bobbin toward a second end thereof forming a voice coil;

a magnet assembly including a permanent magnet defining a center hole therethrough and a ferro-magnetic bottom plate magnetically coupled to a bottom of said permanent magnet with said bottom plate having a generally annular ferro-magnetic pole piece having a hollow center extending axially through said center hole of said permanent magnet arranged substantially coaxially with said bobbin around a distal end of said pole piece with said permanent magnet cooperable with a proximate end of said pole piece to drive said diaphragm via said bobbin in response to an electrical signal applied to said voice coil; and a cooling cap coupled to, and substantially closing said distal end of said hollow center of said pole piece with said cooling cap having at least one short narrow opening therethrough in communication with said hollow center of said pole piece and said interior air chamber of said bobbin with said at least one opening positioned to create, as air is drawn into said chamber, a vortex of air within said chamber as said bobbin is driven upward by said electrical signal applied to said voice coil.

2. The electro-magnetic transducer as in claim 1 wherein said cooling cap having a downward curled edge with said at least one short narrow opening formed in, and extending upward from, the edge.

3. The electro-magnetic transducer as in claim 2 wherein said at least one short narrow opening is angled away from perpendicular to said edge of said cooling cap.

4. The electro-magnetic transducer as in claim 2 wherein said at least one short narrow opening includes a plurality of short narrow openings evenly spaced around said cooling cap.

5. The electro-magnetic transducer as in claim 4 wherein each of said plurality of short narrow openings are angled away from perpendicular to said edge of said cooling cap in the same direction.

6. The electro-magnetic transducer as in claim 5 wherein said short narrow openings are each angled away from perpendicular through the same angle.

7. The electro-magnetic transducer as in claim 6 wherein the angle away from perpendicular is greater than 0° and less than 90°.

8. The electro-magnetic transducer as in claim 6 wherein the angle away from perpendicular is between 10° and 60°.

9. The electro-magnetic transducer as in claim 3 wherein said short narrow opening is shaped having a length that is greater than a width thereof with the angle away from perpendicular being determined relative to the length and shape of said opening.

10. The electro-magnetic transducer as in claim 9 wherein said opening is substantially rectangular.

11. The electro-magnetic transducer as in claim 1 wherein when said voice coil is excited moving said bobbin upward relative to said distal end of the pole piece the volume interior to said bobbin above said cooling cap increases drawing air into said increasing volume interior through said at least one short narrow opening in said cooling cap from said hollow center of said pole piece.

12. The electro-magnetic transducer as in claim 1 wherein said cooling cap has a top side and a bottom side with said top side defining a dimple therein resulting in a projection of said bottom side of the cooling cap to extend toward and or into said hollow center of the distal end of said pole piece.

13. The electro-magnetic transducer as in claim 12 wherein when said voice coil is excited moving said bobbin upward relative to said distal end of the pole piece the volume interior to said bobbin above said cooling cap increases drawing air into said increasing volume interior through said at least one short narrow opening in said cooling cap with said projection of said bottom side of said cooling cap directing air toward said at least one short narrow opening from said hollow center of said pole piece.

14. The electro-magnetic transducer as in claim 12 wherein said cooling cap further comprises a spear-like projection affixed to said projection of said bottom side of said cooling cap that extends into said hollow center of the distal end of said pole piece with said spear-like projection having an increasingly smaller cross-section relative to said cooling cap as said spear-like projection extends into said pole piece with said spear-like projection cross-section along its length being smaller than hollow center of said pole piece.

15. The electro-magnetic transducer as in claim 14 wherein said spear-like projection complements said projection of said cooling cap to direct air to said at least one short narrow opening in said cooling cap.

16. The electro-magnetic transducer as in claim 1 wherein:

said center hole of said magnet has a first diameter;

said magnet assembly further includes a ferro-magnetic top plate defining a center hole therethrough having a second diameter with said top plate magnetically coupled to a top of said magnet;

said pole piece has a outer third diameter and an inner fourth diameter with said pole piece through said center holes of said magnet and said top plate;

with said first through said fourth diameters each progressively smaller than the previous thus forming first gap between said magnet and said outer surface of said pole piece having a width that is the difference between said first and third diameters and a second gap between said top plate and said outer surface of said pole piece having a width that is the difference between said second and third diameters with said second gap being slightly wider than a combination of a thickness of said bobbin together with said voice coil wound thereon to permit free up and down movement with said bobbin and voice coil through both of said first and second gaps; and said bottom plate further defines at least one hole therethrough connecting said first gap to an exterior of said electro-magnetic transducer.

17. The electro-magnetic transducer as in claim 16 wherein when said voice coil is excited moving said bobbin downward relative to said distal end of the pole piece with the volume said interior chamber of said bobbin above said cooling cap decreasing some air is forced through said at least one short narrow opening in said cooling cap into said hollow center of said pole piece to the exterior of said electro-magnetic transducer with additional air is forced out through a space between an inner surface of said second end of said bobbin and said outer surface of said pole piece into said first gap then through said at least one hole through the bottom plate to the exterior of said electro-magnetic transducer.

18. The electro-magnetic transducer as in claim 17 wherein:

said electro-magnetic transducer further includes a basket having a bottom to which said magnet assembly is coupled and a top rim to which an outer edge of said diaphragm is coupled, between said bottom and top rim at least one opening is defined;

said bobbin further defines at least one hole therethrough below a point where said diaphragm is connected to said bobbin and above said voice coil; and when said bobbin moves downward some air from said interior chamber of the bobbin is forced through said at least one hole through said bobbin and then through said at least one opening in said basket to the exterior of said electro-magnetic transducer.

* * * * *